United States Patent [19]

Goldberg

[11] Patent Number: 4,583,652

[45] Date of Patent: Apr. 22, 1986

[54] SAFETY CLOSURE DEVICE

[76] Inventor: James R. Goldberg, 315 Grandview Ave., Novato, Calif. 94947

[21] Appl. No.: 656,781

[22] Filed: Oct. 1, 1984

Related U.S. Application Data

[63] Continuation-in-part of Ser. No. 629,369, Jul. 10, 1984.

[51] Int. Cl.[4] ..... B65D 41/52

[52] U.S. Cl. ..... 215/256; 215/306; 215/320

[58] Field of Search ..... 215/256, 258, 306, 320, 215/354

[56] References Cited

U.S. PATENT DOCUMENTS

| | | | |
|---|---|---|---|
| 773,345 | 10/1904 | Scheidt | 215/306 |
| 2,265,263 | 5/1918 | Sharpe | 215/306 |
| 3,235,117 | 2/1966 | Mason, Jr. | 215/306 X |
| 3,599,821 | 8/1971 | Eggert | 215/320 X |
| 3,904,062 | 9/1975 | Grussen | 215/252 |
| 3,946,891 | 3/1976 | Picoy et al. | 215/320 X |
| 3,994,409 | 11/1976 | Nightengale | 215/306 |
| 3,995,762 | 12/1976 | Pfefferkorn et al. | 215/320 X |
| 4,429,799 | 2/1984 | Zaltsman | 215/306 X |
| 4,474,302 | 10/1984 | Goldberg | 215/256 |

*Primary Examiner*—Donald F. Norton

*Attorney, Agent, or Firm*—Fitch, Even, Tabin & Flannery

[57] ABSTRACT

An improved safety closure device and a method for making same are described. A cylindrical closure element adapted to close the mouth of a bottle or the like by frictional engagement with the interior facing surface of the mouth is joined via a cap portion to a cylindrical retainer collar, extending substantially coaxial with the closure element, by an intercoupling means comprising a tabbed tear strip and a tether strip. The tear strip and the tether strip are integrally formed in a helical configuration extending from the closure element to the collar. The tether strip and tear strip are joined by a pair of frangible webs of a preselected thickness which permit the tear strip to be manually removed. The collar and intercoupling section, including the cap portion thereof, are molded as a unitary structure. The closure element is formed as a separate unitary structure and is secured mechanically to the intercoupling means preferably by a snap-fit means about the periphery of one end of the closure element.

4 Claims, 7 Drawing Figures

SAFETY CLOSURE DEVICE

This application is a continuation-in-part of U.S. Ser. No. 629,369, filed July 10, 1984.

This invention relates generally to closure devices and, more specifically, to an improved safety closure device for use on bottles containing pressurized beverages such as champagne or sparkling wines.

The drinking of champagne or sparkling wine is usually associated with happiness and frivolity. Unfortunately the happiness and frivolity has all too often ended in tragedy because of injuries caused by flying corks. Because of pressure inside a bottle of champagne or sparkling wine, particularly if the wine has been shaken or is warmer than recommended, a cork can be propelled from the bottle at a velocity of well over 120 kph. As a consequence, unattentive individuals opening the bottle, or persons standing nearby, can be seriously injured.

The problem of premature or inadvertent explosive release of champagne corks is exacerbated by the fact that many lower priced champagnes and sparkling wines are closed by molded plastic corks. Plastic corks possess an even greater tendency than natural corks to become dislodged as a result of internal pressure in the bottle. In addition, the slipperiness of plastic is sometimes increased when the cork is molded because of a residue of the release agents often used to facilitate removal of a hot plastic cork from the mold in which it is made. Wetness on the glass surface of the bottle as a result of condensation or seepage of the contents can also reduce friction between the surface of the glass and the surface of the plastic cork.

A novel closure device for a bottle or the like which is particularly well suited for use in connection with champagne and sparkling wines is shown and described in co-pending U.S. application Ser. No. 548,313. The device shown and described therein is a unitary device that employs a plug or a cork as well as a tabbed tear strip and a tether strip that are integrally formed in an outer retaining collar which fits over the neck of the bottle. When the tear strip is torn away, a helical tether strip remains interconnecting the plug or cork and the retainer collar. The cork or plug may thus be easily released from the bottle but is restrained from flying free.

The foregoing device provides a significant advancement in the art of closures for bottles and other containers containing pressurized liquids such as champagne or sparkling wines. The need for additional restraining devices such as wire baskets, shrink wraps, or the like is eliminated. Moreover, it is unnecessary for the person opening the bottle to manually restrain the champagne cork as it is being removed from the bottle.

The new closure device of the aforementioned co-pending application has a cap portion, a cylindrical plug portion extending therefrom, and a cylindrical collar extending substantially coextensively and coaxially with the plug portion. The collar and the plug are spaced from each other to provide an annular cavity for receiving the open end of the container to be closed. Thus, with the plastic closure mounted in place, the plug extends into the opening in the container and the collar surrounds the outside of the container at the opening to retain the plug in position.

The molding of a plastic closure device is typically carried out in an injection molding machine. Such machines usually employ a plurality of die plates and, in appropriate cases, a movable core. The die plates and core move once the device is molded to separate and enable removal of the molded device from the molding machine. Where, as is the case with the new plastic closure device which is the subject matter of this invention, there are two portions extending substantially coextensively and coaxially with each other, the molding procedure and die may be extraordinarily complex. With a cylindrical device, a collapsible mold core may typically be provided making removal of the molded part after molding relatively simple. However, in the present case, a collapsible core is not practical due to the presence of the plug portion of the unitary closure device coextensive and coaxial with the surrounding cylindrical collar. This problem is exacerbated where the collar is provided with an annular recess for mating with a retaining ring on the bottle or other container because of the difficulty the needed core shape presents in withdrawing the core from the annular cavity between the plug portion and the cylindrical collar.

It is an object of the present invention to provide an improved safety closure device for use on bottles containing pressurized beverages such as champagne or sparkling wines.

Another object of the invention is to provide an improved safety closure device and an improved method for making same which facilitates manufacture of the device.

Another object of the invention to provide an improved safety closure device and an improved method for making same, wherein the device includes a cylindrical plug or closure element extending coaxially with an outer cylindrical collar, the latter serving to retain the closure device on the container.

A still further object of the invention to provide an improved safety closure device and an improved method for making same wherein the safety closure device is manufactured in two separate operations with subsequent automated assembly of the separately manufactured parts.

Other objects of the invention will become apparent to those skilled in the art from the following description, taken in connection with the accompanying drawings wherein.

Very generally, the safety closure device of the invention comprises a cylindrical plug or closure element adapted to close the mouth of a bottle or the like by frictional engagement with the interior facing surface of the mouth of the container. A cylindrical retainer collar is provided and an intercoupling means connect the collar to the plug element with the plug element and the collar extending substantially coaxially with each other. The intercoupling section comprises a tabbed tear strip and a tether strip. The tear strip and the tether strip are integrally formed in a helical configuration extending from the closure element to the collar. The tether strip and the tear strip are joined by a pair of frangible webs of a preselected thickness to permit the tear strip to be manually removed. The collar and the intercoupling means, including a cap portion, are comprised of a unitary molded structure. The plug or closure element is comprised of a separate unitary structure that is mechanically secured to the intercoupling means. In a preferred form, the plug or closure element is secured to the intercoupling means about the periphery of one end of the plug or closure element by means of an annular rib mating in a corresponding annular recess.

Figure 1:
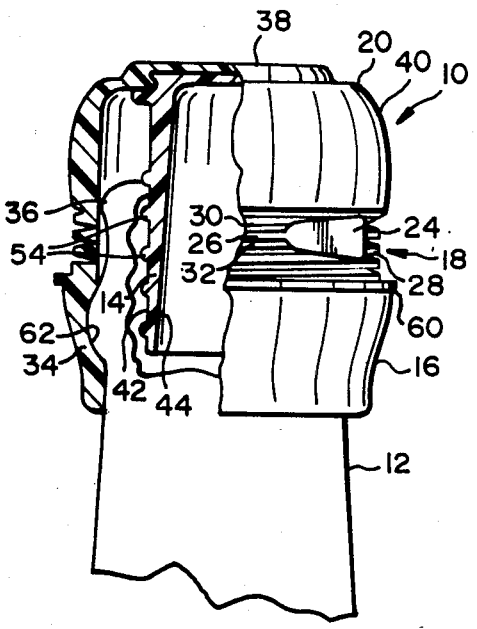
FIG. 1 is a partially sectional side view of a safety closure device constructed in accordance with the present invention.
Figure 2:
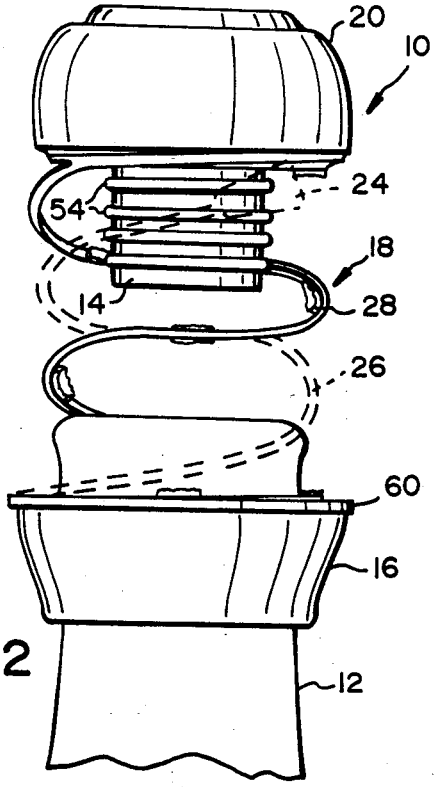
FIG. 2 is a partially sectional side view of the device of FIG. 1 illustrating partial removal of a tabbed tear strip.

A closure device of the type to which the present invention relates is illustrated in FIGS. 1 and 2. As shown, the safety device includes a closure element or plug. Those skilled in the art will realize that the plug per se is not a material limitation of the disclosed safety device. As a result the safety device also comprises the separate combination of a cap portion, an intercoupling means and a collar when the combination is made or used to restrain a separately manufactured plug or closure element.

The safety closure device 10 is shown mounted on the neck of a bottle 12 designed to hold pressurized liquids such as champagne or other sparkling wines. The device 10, as shown, includes a closure element or plug 14 and a retainer collar 16 both connected to a cap portion 20. The plug 14 is adapted to close the mouth of the bottle by frictional engagement with the interior facing surface of the mouth. An intercoupling section 18 is attached to collar 16. Intercoupling section 18 is comprised of a tabbed 24 tear strip 26 and a tether strip 28 that are formed integrally in the intercoupling section as parallel helices extending one or more turns from the cap 20 to the collar 16. The tether strip 28 and the tear strip 26 are interconnected by a pair of grooved frangible webbed sections 30 and 32. The thickness and configuration of the pair of grooved frangible webs are preselected to be less than the thickness of the tether and tear strips. The tear strip 26 also contains the integral pull tab portion 24 which provides an easy and convenient means for grasping the tear strip 26 prior to its removal as described below.

When the pull tab portion 24 of the tear strip 26 is grasped and pulled by one wishing to open a bottle of sparkling wine, the tear strip 26 separates from tether strip 28 because of a tearing of the frangible web sections 30 and 32 along the path of the grooves between the tether and tear strips. When the helical tear strip 26 is removed, the helical tether strip 28 remains to interconnect element 14 and collar 16 thus enabling element 14 to be released from the bottle 12 without flying free.

The bottle 12 in FIGS. 1 and 2 is typical of bottles used to contain champagne and sparkling wines. Such bottles often have elongated, tapered, cylindrical necks containing a circumferential bulge or ridge 34 (known to the trade as a "finishing or bead ring") just below a lip 36 at the top of the bottle. The circumferential ridge 34 protrudes from the side of the bottle with sufficient radius to provide a means for restraining or impeding objects or devices, fastened above or below it, from moving up or down the neck of the bottle. In the past, such objects and devices have included, for example, woven wire baskets used to restrain plugs or corks. In the present invention, the circumferential ridge 34 is used to restrain the retainer collar 16.

In a preferred form the closure device 10 is entirely formed of a moldable resilient substance. Alternate embodiments which utilize plug portions 14 formed of "natural" or "wood" cork or cork-like substances are discussed supra.

While polymerized plastic is a preferable resilient substance for use in the present invention other resilient substances are suitable as long as they are weak in shear when thin but strong in tension when thick. As used herein, "weak in shear when thin" means a substance that is manually tearable when used at the preselected thickness of the thin frangible webs connecting the tear and tether strips. "Strong in tension when thick" means that, at the thickness of the tether strip, the substance is strong enough to withstand longitudinal strain caused by sudden release of the cork from the bottle.

For purposes of this invention, a suitable resilient substance will be moldable and will have sufficient resiliency to allow the retainer collar 16 to stretch but not break as it is inserted over the neck of the bottle, including the circumferential ridge 34. Following the expansion necessary to allow the retainer collar 16 to pass over the circumferential ridge 34, a suitable material will still have sufficient resiliency to allow the collar to assume a shape that conforms generally to the contour of the outside of the bottle.

The cap 20 is of generally cup-like shape and is comprised of a circular disk-like top portion 38 integrally molded with a hollow cylindrical side portion 40. The diameter of the cap's circular top portion 38 is greater than the diameter of top of the bottle neck. The inner circumference of the cap's hollow cylindrical side portion is greater than the outer circumference of the lip 36 at the top of bottle.

Pursuant to the present invention, the plug 14 is formed as a separate unit from the remainder of the device, namely, the collar 16 and intercoupling means 18, including cup-like cap portion 20. The device is then assembled as explained supra, prior to mounting on the bottle being closed. Alternatively, if a plug has been inserted into a bottle, it may be desirable to then attach the separate combination of the cap portion, the intercoupling means and the collar.

In a preferred form plug 14 is comprised of a synthetic moldable resilient material such as polymerized plastic. In this form the plug is preferably hollow having an outer cylindrical wall surface 42 and an inner cylindrical wall surface 44. Alternatively, plug 14 is comprised of a natural material such as cork or a modified natural material such as a composition material containing cork or a cork-like substance. In this alternative form plug 14 will preferably be solid rather than hollow.

In both the preferred and alternative forms, the cylindrical plug 14 has an outer diameter very slightly smaller than the diameters of the opening at the top of the bottle and the upper inner portions of the bottle neck. This allows the plug to fit tightly down into the neck of the bottle. Also, in both the preferred and alternative forms, the top of the plug 14 is mechanically connected to the inside of the circular disk-like top portion 38 on the cap 20 as explained in detail below.

When plug 14 is comprised of a synthetic moldable resilient material such as polymerized plastic, a series of parallel annular ridges 54 may protrude slightly from the plug's outer wall surface 42 about halfway down its length. The width and height of the annular ridges are approximately equal. The annular ridges extend down the outer wall 42 of the plug to a point approximately in line with the bottle's circumferential ridge 34 when the device 10 is in place in a bottle 12. When in place, the circumferential wall of the plug 14 supports the annular ridges against the inner wall of the bottle neck. As a result, the annular ridges grasp against the side of the bottle helping to seal its contents.

The intercoupling section 18 joins the cap 20 and the retainer collar 16. The intercoupling section is comprised of a tabbed 24 tear strip 26 and a tether strip 28. The tab 24 on the tear strip 26 may be suitably roughened, not shown, to help prevent the tab from slipping when grasped by a person wishing to remove the tear strip from the closure device.

The tear strip 26 and the tether strip 28 are formed integrally in parallel helices extending from the cap 20 to the collar 16. In a preferred form the tear and tether strips do not begin at the same region, nor do they end in the same region on the collar. They preferably begin or end separated from one another by an arc of approximately 60°. Such an arc permits complete separation of the tear strip from the closure device.

The tear and tether strips preferably extend one or more turns from the cap 20 to the collar 16. Any number of turns can be used in the present device as long as they allow the tether strip to permit removal of the plug 14 while still adequately restraining the plug 14 from flying free. Between one and two turns is especially preferred.

The tether strip 28 and the tear strip 26 are interconnected by a pair of grooved frangible webs 30 and 32. The grooves between the tether strip and the tear strip, formed by the frangible webs, extend from the cap 20 to the collar 16. The webs may be continuous, or may be broken by a series of openings, not shown, which facilitate removal of the tear strip. The segments of the webs are selected in size and number to provide sufficient strength to maintain a cohesive structure until removal of the tear strip. The tear strip 26 is removable by manually causing the webs to tear. Following removal of the tear strip 26, as shown in FIG. 2, the tether strip 28 remains attached to the cap 20 and the collar 16. This may be accomplished by means of a merging brought about by a gradual diminution of the depth of the groove separating the cap or collar material from the initial or final tether turns.

In addition to providing the means for connecting the cap 20 to the retainer collar 16, the intercoupling section 18 creates an integral tamper proof safety seal between the cap 20 and the collar 16 because it unmistakably indicates by dismemberment if the product has been prematurely opened or tampered with anywhere between the bottler's facilities and the end user's location.

The retainer collar 16 is comprised of a hollow tapered cylinder that fits around the top outside portion of the bottle neck. The cylinder is tapered both in shape and in thickness. The tapered shape of the retainer collar 16 generally mirrors the contour of the taper on the champagne or sparkling wine bottle 12. At the lower end of the intercoupling section 18, a small circumferential ridge 60 is provided that protrudes from the outer surface of the collar 16. Just below ridge 60, on the inner surface of the collar wall, the collar contains a circumferential groove or annular recess 62. The shape and size of the recess 62 generally mirrors and approximates the shape and size of circumferential ridge 34 on the outer surface of the champagne or sparkling wine bottle. When the tethered safety closure device 10 is installed on a champagne or sparkling wine bottle, the collar's annular recess 62 fits around the circumferential ridge 34 on the neck of the bottle, holding the collar in place. Security of the collar on the bottle neck is assured by providing sufficient thickness in the wall of the collar below groove 62 to prevent circumferential expansion and consequent upward movement of the collar 16 as a result of pressure in the bottle.

When the tear strip has been removed from the intercoupling means, it is possible that someone wishing to remove the "cork" from the bottle of sparkling wine could attempt to do so by "twisting" the cap portion rather than forcing the "cork" up and out of the bottle. If the retainer collar fits very tightly around the outside of the bottle, it is also possible this twisting motion could cause the tether strip to break. To protect against this possibility, in preferred forms retainer collar 16 will fit snugly around the neck of the bottle but retain enough clearance to laterally "twist" with the cap if attempts are made to remove the cork in this manner.

Because of the design of the tethered safety closure device and the material used to construct it, the improved tethered safety closure device of the present invention can easily be inserted on bottles containing champagne or sparkling wine. The thickness at the bottom of the retaining collar is selected to facilitate placing the device on the wine bottle. The resiliency of the material used to make the tethered safety closure device allows it to expand and contract as necessary to fit securely in and around the neck of the bottle. This resiliency can be increased with heat if the properties of the material so warrant.

According to the invention, the closure element or plug 14 is formed as a separate unitary device from the combination of collar 16, cap 20 and intercoupling means 18. The device may then be assembled as explained below.

Figure 3:
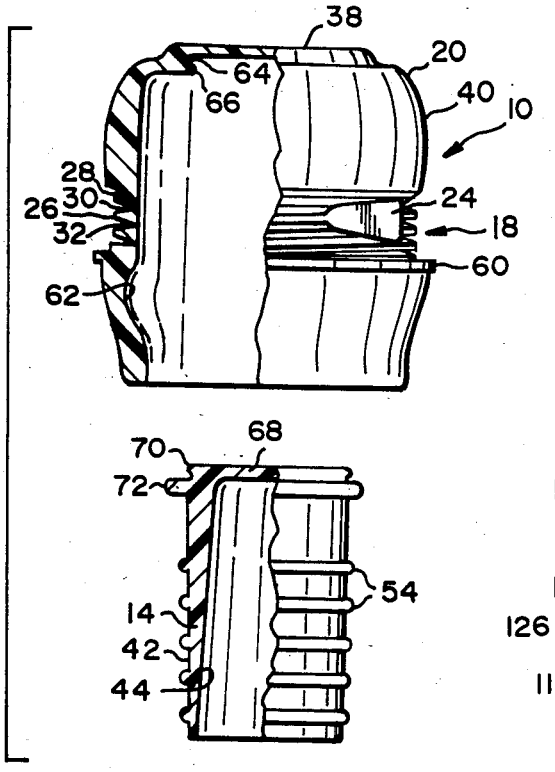
FIG. 3 is an exploded view of the device of FIG. 1 illustrating the manufacture of the device in two separate parts.

As may be seen in FIG. 1, the cap-like portion 20 which extends over the lip 36 of the container 12 and down a short distance on either side is formed integrally with the collar 16 and, as such, constitutes a continuation of the intercoupling means 18. In preferred forms the interior surface of the cap-like portion 20 is formed with an annular recess 64, leaving a lip 66 of the molded material, which is resilient, extending about the periphery of the annular recess. (See FIG. 3).

In addition, in preferred forms (see FIG. 3) plug or closure element 14 is molded and is closed at one end by a wall 68 and is provided with an annular protuberance or rib 70 adapted to fit in the recess 64 after snapping past the resilient lip 66. A flange 72 molded integrally with plug or closure element 14 abuts the interior surface of the cup-like portion 20 below the ridge 66 to stabilize the closure element. Further stability is imparted by the upper surface of the wall 68 abutting the inner surface of the disk-like portion 38. Thus, in this preferred form the closure device of the invention may be snapped together readily and is well adapted to automated assembly. Further stability may be provided, if desired, by welding the two pieces together where they abut.

Figure 4:
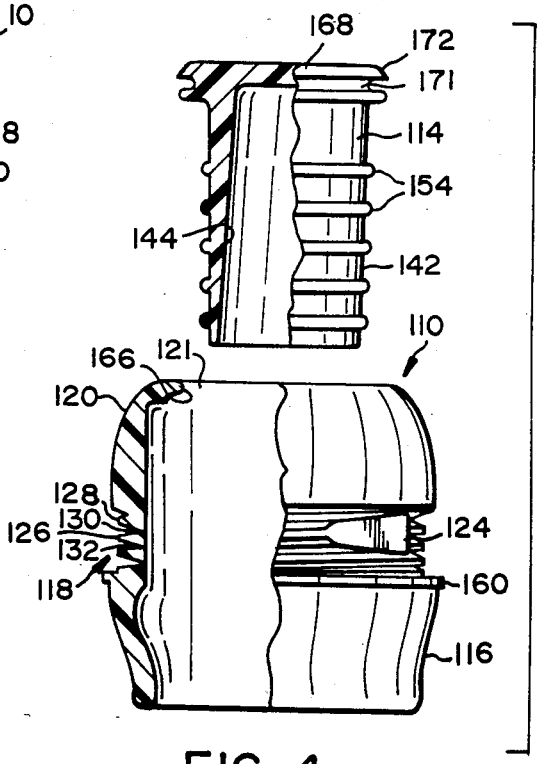
FIG. 4 is an exploded view similar to FIG. 3 illustrating a first alternate embodiment of the invention.

Referring to FIG. 4, a first alternative embodiment of the invention is shown. In the embodiment of FIG. 4, elements corresponding to those of FIGS. 1-3 have been given identical reference numbers, preceded by the numeral 1. The cup-like cap portion 120 has a circular opening 121 therein. An annular rib 166 extends inwardly at the periphery of the opening 121. Plug or closure element 114 is provided with a corresponding annular recess 171 around the periphery near one end thereof. A flange 172 projects outwardly from the circular cap closing the end of the plug or closure element. The plug or closure element is inserted into the opening in the cup-like cap and pushed inwardly until the annular ridge snaps into the annular recess. The flange stabilizes the plug or closure element in the cup-like cap portion. Once again, the nature of the two-piece construction with the snap fit is readily adaptable to automated assembly. Further stability may be provided by welding in the regions of contact between the plug or closure element and the cup-like cap portion.

Figure 5:
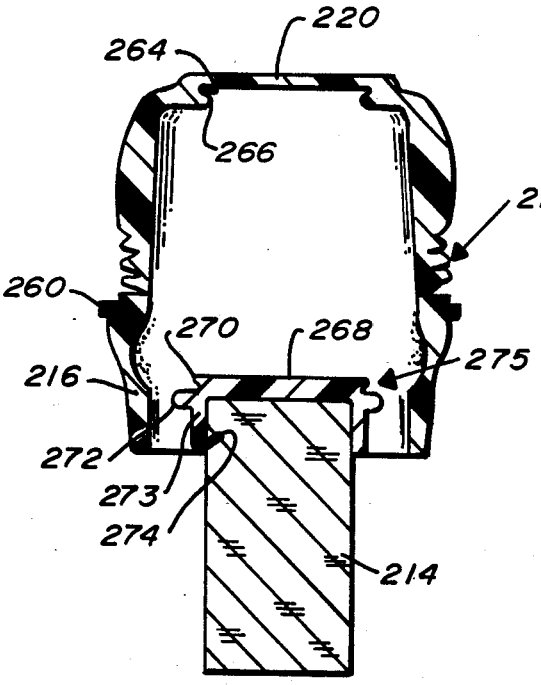
FIG. 5 is an exploded view similar to FIG. 3 illustrating a second alternate embodiment of the invention.

Referring to FIG. 5, a second alternative embodiment of the invention is shown. In the embodiment of FIG. 5, elements corresponding to those of FIGS. 1–3 have been given identical reference numbers, preceded by the numeral 2. In this embodiment, plug or closure element 214 is a solid cylinder that is formed of natural or wood cork or a cork containing composition. One end of cylinder 214 fits into and is joined to a molded resilient capped circular collar 275 closed at one end by a wall 268. As a result, when plug 214 is joined to collar 275, a periphery of plug 214 abuts with the inner surface of wall 268. Collar 275 is preferably provided with an annular protuberance or rib 270 adapted to fit in recess 264 on cap 220 after snapping past resilient lip 30 266 (See also FIG. 3). According to the invention, cylindrical plug 214 can be joined to collar 275 at regions of contact by any joining means known to the art. Such means include, but are not limited to, welding, bonding, gluing and stapling. Collar 275 may include a circular side wall 273 that extends down from rib 270. On its inner surface, side wall 273 may further include one or more sharp individual protuberances 274, or one or more sharp annular protuberances (not shown) designed to dig into the side surfaces of plug 214, thereby providing additional means for securing plug 214 to collar 275.

Figure 6:
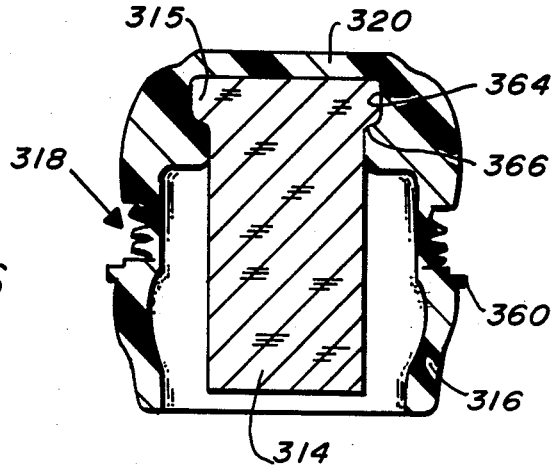
FIG. 6 is a view in section a third alternate embodiment of the invention.

Referring to FIG. 6, a third alternative embodiment of the invention is shown. In the embodiment of FIG. 6, elements corresponding to those of FIGS. 1–3 have been given identical reference numbers preceded by the numeral 3. In this embodiment, plug or closure element 314 is also formed of natural cork or a cork containing composition. However, in this embodiment, cylindrical plug 314 additionally has an annular cap portion 315 whose diameter exceeds that of the cylindrical plug portion that fits down into the neck of the bottle. Such annular cap portions can have a variety of shapes (not shown), ranging from flat caps to the more rounded ones used on "traditional" champagne corks. In one form of this embodiment, annular cap portion 315 will be somewhat flat and will have a diameter only slightly larger than the diameter of the cylindrical plug portion. In this embodiment, the inner contour of cap-like portion 320 will mirror the outer contour of annular cap portion 315. In addition, cap-like portion 320 is formed with an annular recess 364, leaving a lip 366 of molded material, which is resilient, extending about the periphery of the annular recess. The shape and depth of annular recess 364 will mirror the size and shapes of the annular cap-portions 315 of plug 314. As a result, capped plug 314 can be "force fit" into the annular recess 364 of cap-like portion 320. Plug 314 may be joined to cap 320 at regions of contact between cap 320 and annular cap portion 315 by any joining means known to the art. Again such means include, but are not limited to, welding, bonding, gluing and stapling.

Figure 7:
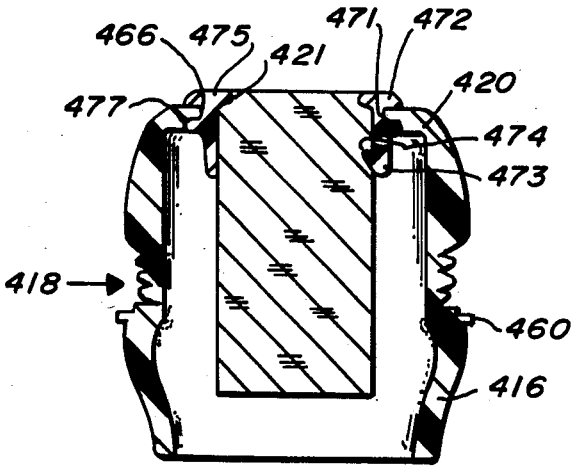
FIG. 7 is a view in section a fourth alternate embodiment of the invention.

Referring to FIG. 7, a fourth alternative embodiment of the invention is shown. In the embodiment of FIG. 7, elements corresponding to those of FIGS. 1–3 have been given identical reference numbers preceded by the numeral 4. In this embodiment, plug or closure element 414 is also formed of natural cork or a cork containing composition. In addition, as in a second alternative embodiment, a circular collar 475 is joined to plug 414, thereby providing a means for securing the plug 414 to cup-like portion 420. However, in the present embodiment circular collar 475 has no upper wall surface (see 68, 168) but rather has a circular opening at the top end thereof that is of slightly smaller circumference than the circumference of a first end of plug 414. As a result, in this embodiment collar 475 is more "ring like" than "cap-like". In addition, in this embodiment collar 475 has a side wall 473 which may on its inner side include one or more sharp individual protuberances 474, or one or more sharp annular protuberances (not shown) designed to dig into the side surface of plug 414, thereby providing additional means for securing plug 414 to collar 475.

In this embodiment, cup-like cap portion 420 has a circular opening 421 therein. An annular rib 466 extends inwardly at the periphery of opening 421. Circular collar 475 also has a corresponding annular recess 471 around the periphery thereof, and a flange 472 which projects outwardly from the collar just above annular recess 471.

Plug 414 fits into and is joined to ring-like collar 475. Any means known to the art, including bonding, can be used to secure the facing surfaces of plug 414 and collar 475 to one another. After plug 414 has been joined to collar 475, the resulting assemblage is inserted into opening 421 in the cup-like cap 420 and pushed inwardly until the annular rib 466 snaps into the annular recess 471. The flange further stabilizes the plug or closure element 414 in the cup-like cap portion 420.

From the various embodiments disclosed herein it can be seen that the device and method of the invention make it possible to readily manufacture the closure device of the invention by manufacturing the device in two separate operations with subsequent automated assembly. Stability is provided between the two separately formed parts and the integrity of the assembly may be enhanced by a further welding operation if desired. Once assembled, the device may be installed in a single step by standard bottling apparatus.

Various modifications of the invention in addition to those shown and described herein will become apparent to those skilled in the art from the foregoing description and accompanying drawings. Such modifications are intended to fall within the scope of the appended claims.

I claim:

1. A safety closure device comprising, a cylindrical closure element adapted to close the mouth of a bottle or the like by frictional engagement with the interior facing surface of the mouth, a cylindrical retainer collar, and an intercoupling means connecting said collar to said closure element with said closure element and said collar extending substantially coaxially with each other, said intercoupling means further comprising a cup-like portion that is shaped to extend over the lip of the container, said intercoupling means comprising a tether strip integrally formed in a predetermined configuration extending from said cup-like portion to said collar, said tether strip being joined to and separable from the rest of said intercoupling means along a substantial portion of its length by a pair of frangible webs of a preselected thickness to permit said tether strip to be manually separated, said closure element comprising a separate unitary structure and being secured to said cup-like portion of said intercoupling means about the periphery of one end of said closure element said closure element being cylindrical and being formed of a material selected from the group comprised of cork or a cork composition material, said cork or cork composition closure element being attached to a collar having means to mate with said intercoupling means thereby mechanically securing said closure element to said intercoupling means.

2. A closure device according to claim 1 wherein said cup-like portion of said intercoupling means includes a circular recess therein for receiving said one end of said closure element.

3. A closure device according to claim 1 wherein said closure element and said cup-like portion have annular snap-fit interengaging portions securing said closure element to said cup-like portion of said intercoupling means about the periphery of one end of said closure element.

4. A closure device according to claim 1 wherein said cup-like portion of said intercoupling means includes a circular opening therein for receiving said one end of said closure element.

* * * * *